United States Patent [19]

Becka

[11] 4,068,336

[45] Jan. 17, 1978

[54] MACHINE FOR CLAMPING THE HEEL PORTION OF AN UPPER TO THE CORRESPONDING PORTION OF A FORM

[75] Inventor: Michael M. Becka, Nashua, N.H.

[73] Assignee: International Shoe Machine Corporation, Nashua, N.H.

[21] Appl. No.: 747,578

[22] Filed: Dec. 6, 1976

[51] Int. Cl.[2] ..... A43D 21/00

[52] U.S. Cl. ..... 12/14.4

[58] Field of Search ..... 12/14.4, 10.1, 10.5, 12/12.4, 12.5, 8.1, 54.3

[56] References Cited

U.S. PATENT DOCUMENTS

| | | | |
|---|---|---|---|
| 2,915,765 | 12/1959 | Lauretti | 12/54.3 |
| 3,096,531 | 7/1963 | Rockwell | 12/14.4 |
| 3,325,841 | 6/1967 | Leonhardt | 12/14.4 |
| 3,332,096 | 7/1967 | Kamborian et al. | 12/14.4 |

*Primary Examiner*—Patrick D. Lawson
*Attorney, Agent, or Firm*—Albert Gordon

[57] ABSTRACT

A machine for clamping the heel portion of an upper to the corresponding portion of a form wherein the upper is mounted on the form, disclosed as a last, and the heel portion of the upper is clamped to the form by a clamp pad having a bight that bears against the heel end extremity of the upper and a pair of legs extending forwardly and divergently of the bight that bear against the sides of the heel portion of the upper. The pad legs are each connected to a plate that is located outwardly of its associated pad leg and that is mounted for inward-outward movement, the plates and the pad legs being yieldably urged outwardly. A head is so mounted in intersecting relationship with each plate as to enable the heads to engage the plates and thereby force the plates inwardly to cause the pad legs to bear against the sides of the heel portion of the upper.

22 Claims, 13 Drawing Figures

MACHINE FOR CLAMPING THE HEEL PORTION OF AN UPPER TO THE CORRESPONDING PORTION OF A FORM

BACKGROUND OF THE INVENTION

U.S. Pat. Nos. 2,915,765; 3,096,531; and 3,141,183 are illustrative of machines for clamping the heel portion of an upper against the corresponding portion of a form while a shoe assembly comprised of the form and the upper mounted thereon is supported in position to be clamped. The clamping is effected by a clamp pad having a pair of legs extending divergently from a bight with the pad bight being caused to bear against the heel end extremity of the upper and the pad legs being caused to bear against the sides of the heel portion of the upper.

SUMMARY OF THE INVENTION

In accordance with this invention, an improved mechanism is provided to effect the application of the pad legs against the sides of the heel portion of the upper. To accomplish this, a plate, mounted for inward-outward movement, is located outwardly of each pad leg, each plate being connected to its associated pad leg. The plates are resiliently urged outwardly to cause the pad legs to be resiliently urged away from the sides of the heel portion of the upper into positions wherein the plates are so inclined that the ends of the plates closest to the pad bight are the parts of the plates that are closest to each other and the other ends of the plates are furthermost from each other. A head is mounted for movement towards and away from each plate so as to be in intersecting relationship with its associated plate, each head being initially spaced from its associated plate. In order to force the pad legs against the sides of the heel portion of the upper, the heads are caused to so move as to intersect the plates and move the plates inwardly thus causing the pad legs to move inwardly.

In the illustrative embodiment of the invention, the invention is incorporated in a machine similar to that shown in U.S. Pat. No. 3,096,531 for molding or shaping the heel portion of an upper to the shape of the heel portion of a last on which the upper is mounted and for attaching the heel end extremity of the upper margin to the corresponding portion of an insole that is mounted to the last bottom. Such an operation is desirable preparatory to presenting a shoe assembly to a pulling over and toe lasting machine, such as that shown in U.S. Pat. No. 3,902,211, that stretches the toe portion of the upper about the last, wipes the toe portion of the upper against the insole and attaches the wiped toe portion of the upper against the insole in order that the upper may be properly oriented in the last prior to the presentation of the shoe assembly to the pulling over and toe lasting machine. The invention, however, has utility in other types of machines such as a heel lasting machine performing the operation shown in U.S. Pat. No. 3,141,183 or U.S. Pat. No. 3,719,964 or a heel shaping machine performing the operation shown in U.S. Pat. No. 2,915,765.

DESCRIPTION OF THE PREFERRED EMBODIMENT

Figure 1:
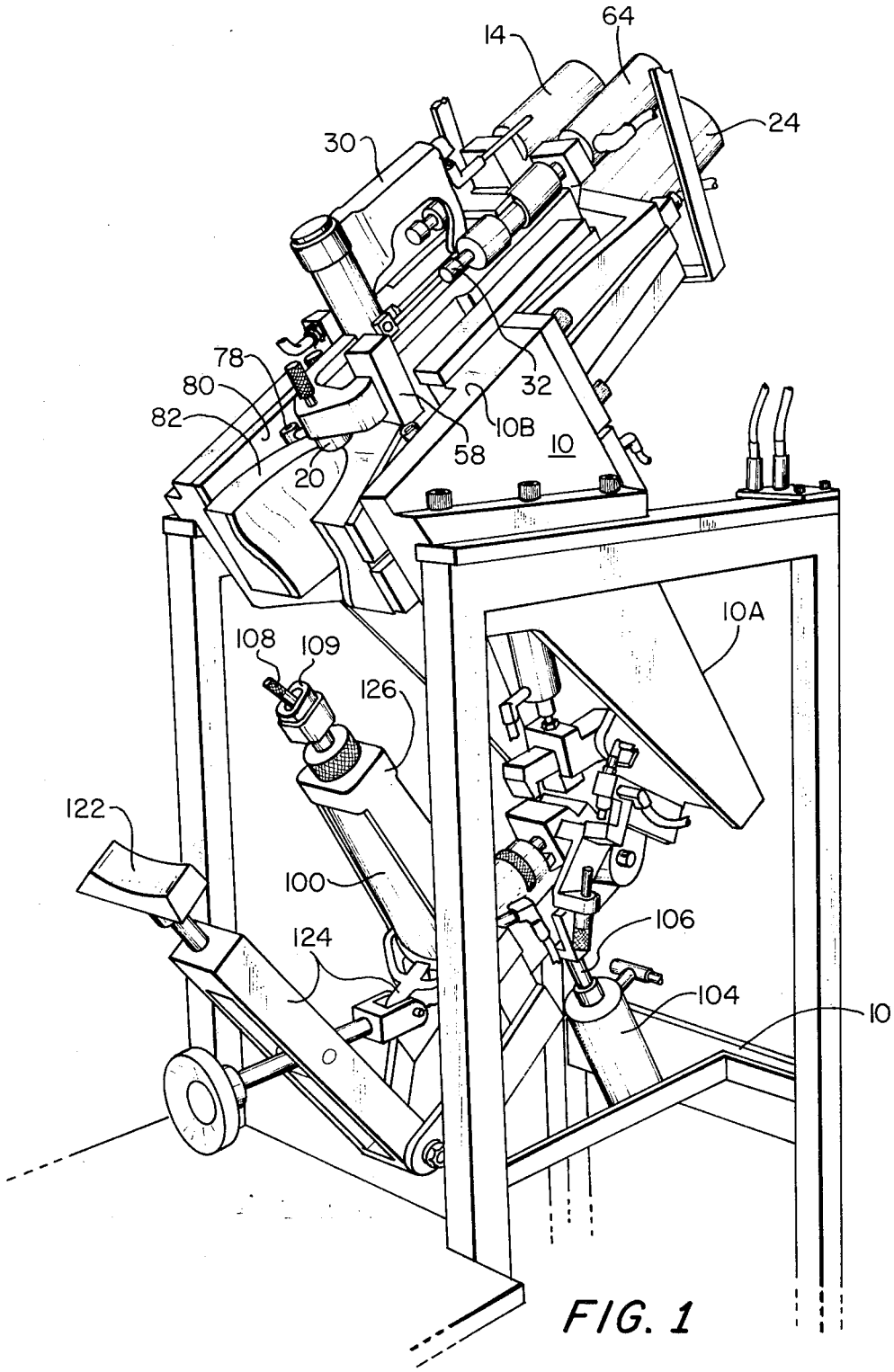
FIG. 1 is an isometric view of the machine.
Figure 3:
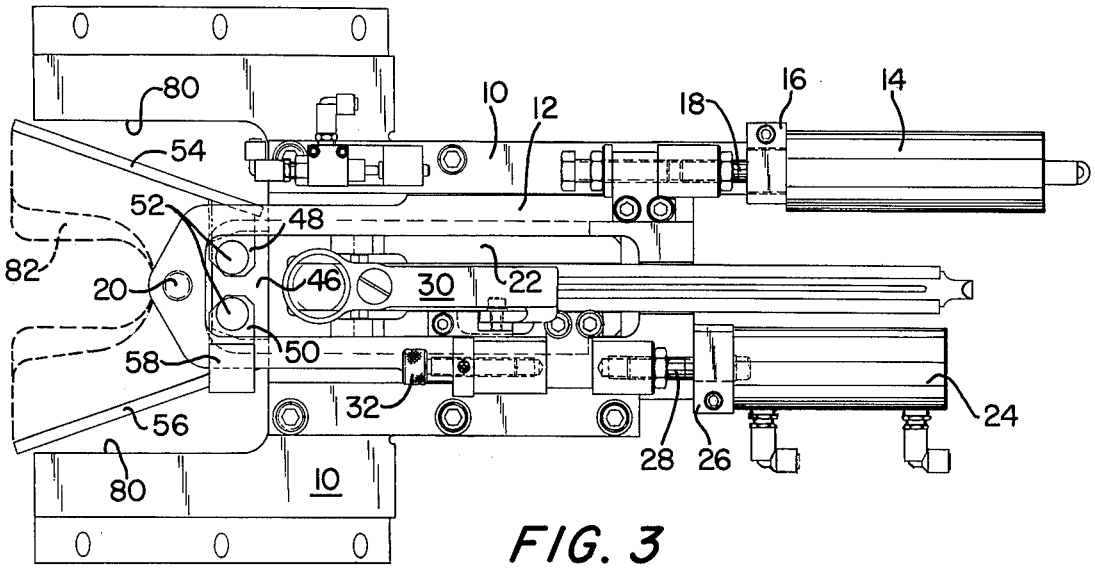
FIG. 3 is a plan view taken on line 3—3 of FIG. 2.

As shown in FIG. 1, for ease of presentation of a shoe assembly to the machine, the machine is inclined. The machine includes a frame 10, referred to below, that has surfaces 10A and 10B. For ease of explanation, the plane of the surface 10A will be considered to be vertical and the plane of the surface 10B, which is substantially at right angles to the plane of the surface 10A, will be considered to be horizontal.

The operator is intended to stand to the left of the machine as seen in FIG. 1. Directions extending toward the operator (right to left in FIG. 1) will be considered to be "forward" and directions extending away from the operator (left to right in FIG. 1) will be considered to be "rearward". The fronts of the machine and elements of the machine are considered to be those parts closest to the operator and the backs of the machine and elements of the machine are considered to be those parts furthermost from the operator.

Referring to FIGS. 1–4, the machine includes stationary frame 10 in which a hold-down slide 12 is mounted for forward-rearward movement. An air operated motor 14 is affixed to a lug 16 on the frame 10 and the piston rod 18 of the motor 14 is connected to the slide 12 thereby enabling the motor 14 to effect forward-rearward movement of the slide 12. A hold-down 20 is mounted to the front of the slide 12.

A staple gun slide 22 is mounted for forward-rearward movement in the hold-down slide 12. An air operated motor 24 is affixed to a lug 26 on the hold-down slide 12 and the piston rod 28 of the motor 24 is connected to the slide 22 thereby enabling the motor 24 to effect forward-rearward movement of the slide 22. A pneumatically operated staple gun 30, which is of itself known, is mounted to the slide 22. In addition, a prong 32 is mounted to the slide 22 for forward-rearward adjustment on the slide 22.

Referring to FIGS. 2, 3, 5 and 6, an air operated motor 34, pivotally mounted on the frame 10 on a pivot pin 36, has an upwardly extending piston rod 38 that is pivotally connected to a first arm of a bell crank lever 40. The bell crank lever 40 is pivoted to the frame 10 by a pin 42 and the second arm of the lever 40 is pivoted by a pin 44 to a rod 46 that is slidably mounted for forward-rearward movement in the frame 10.

Figure 8:
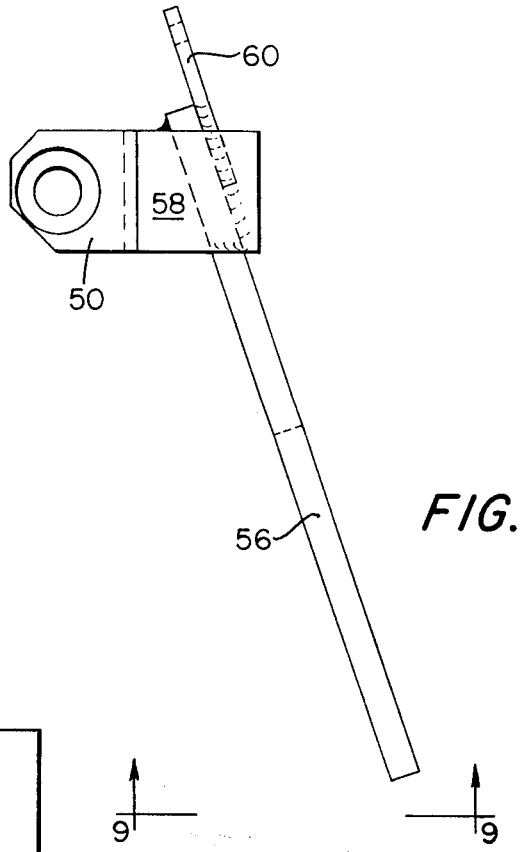
FIG. 8 is a plan view of one of the plates and a finger and a lug connected thereto.
Figure 9:
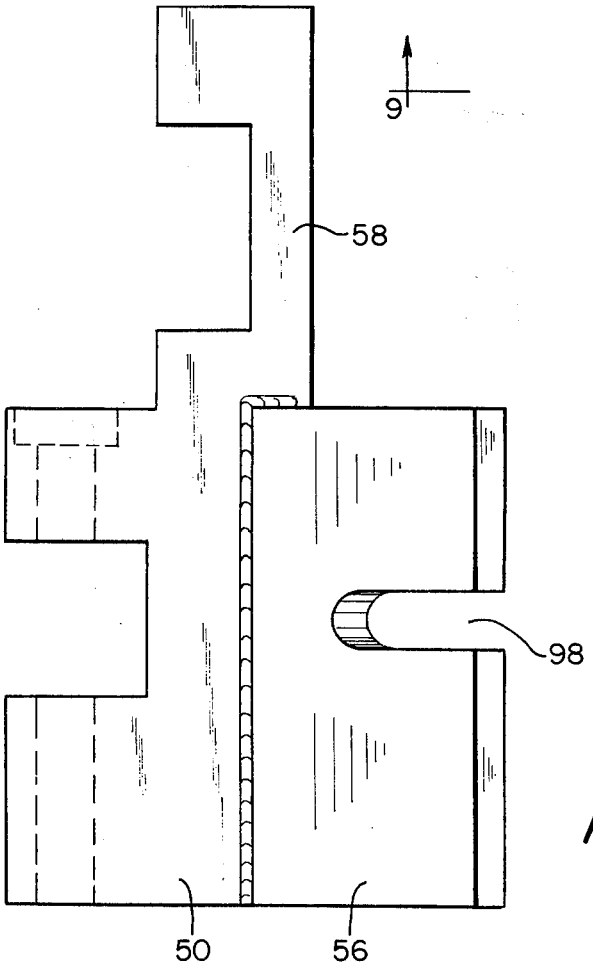
FIG. 9 is a front elevation taken on the line 9—9 of FIG. 8.

Fingers 48 and 50 are pivoted to the front of the rod 46 by pins 52 and extend outwardly of the rod 46 on opposite sides of the rod 46. Plates 54 and 56 are respectively secured, as by welding, to the outer ends of the fingers 48 and 50 and extend forwardly and outwardly thereof. Referring to FIGS. 8 and 9, a lug 58 is formed on the finger 50 so as to extend upwardly thereof in forward-rearward alignment with the prong 32. Strips 60 are secured to and extend rearwardly of the plates 54 and 56. A tension spring 62 is secured to and extends between the strips 60 to thereby yieldably urge the fingers 48 and 50 rearwardly about the axes of the pins 52 and thus yieldably urge the plates 54 and 56 outwardly.

Figure 5:
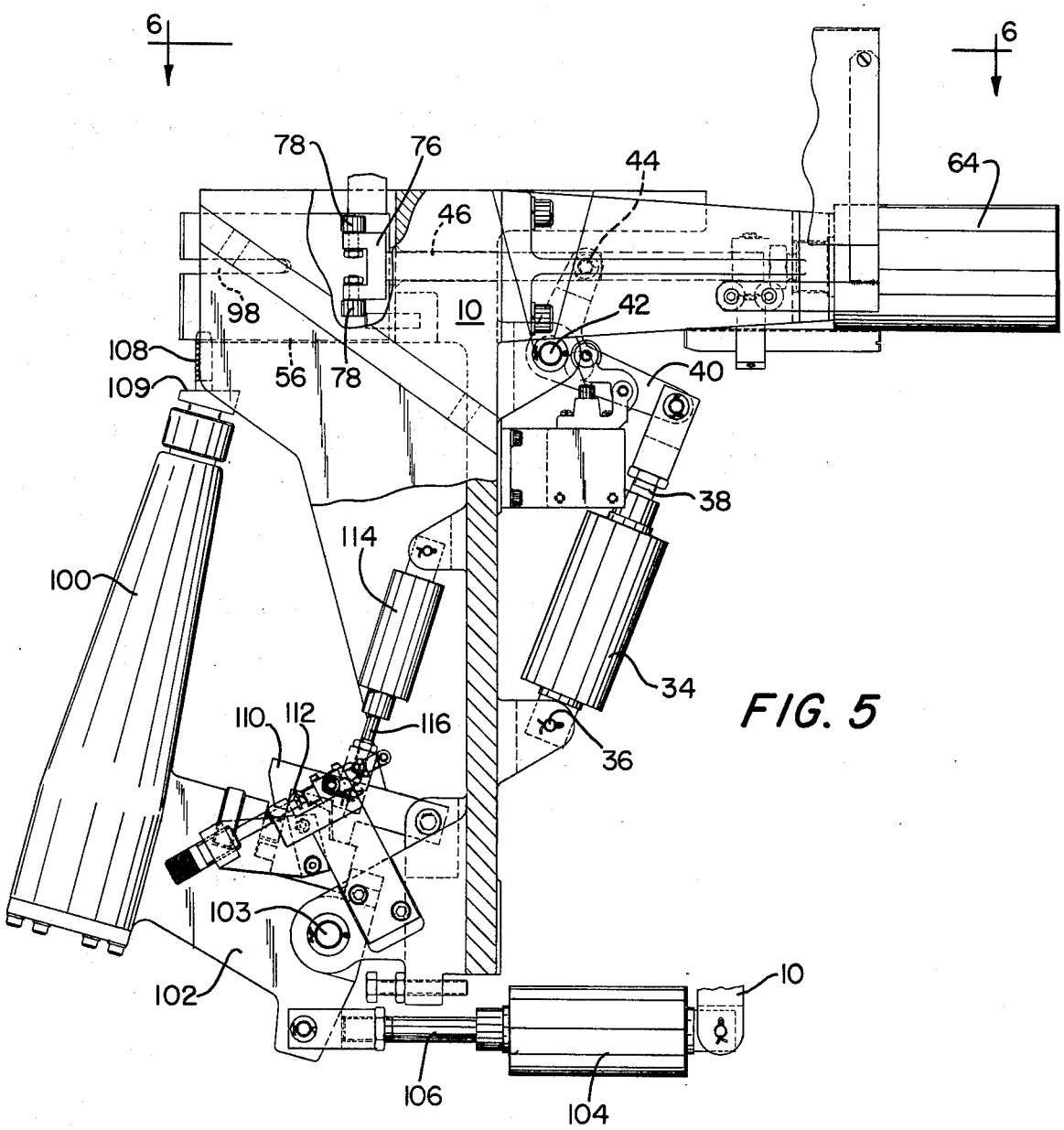
FIG. 5 is a partially sectional elevation of part of the machine.
Figure 6:
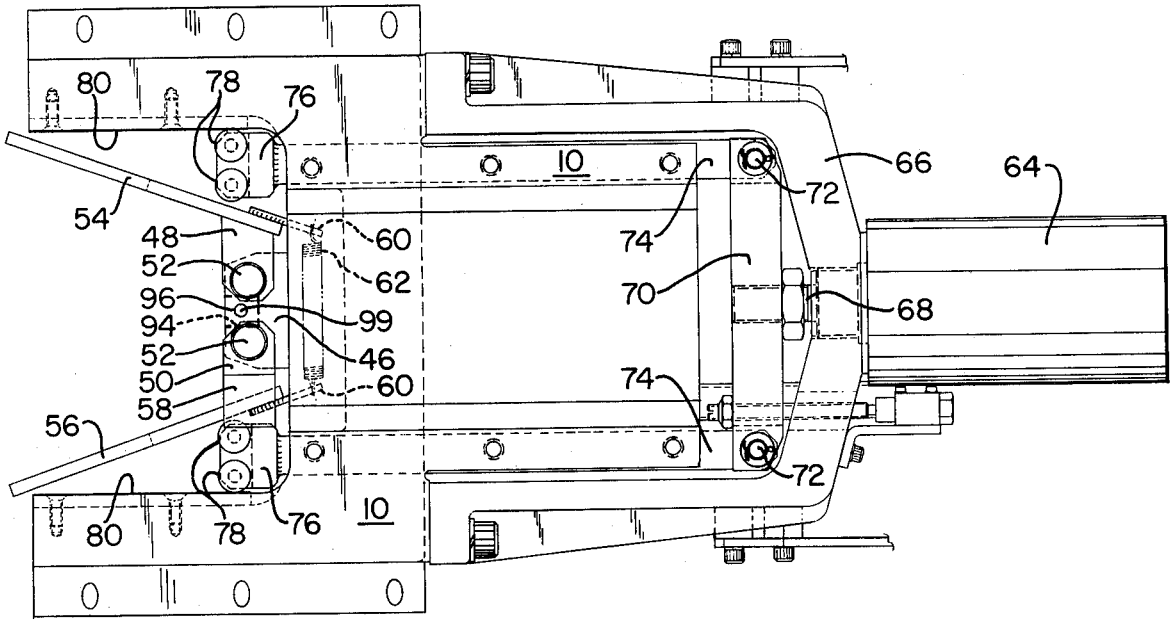
FIG. 6 is a plan view taken on the line 6—6 of FIG. 5.

Referring to FIGS. 5 and 6, an air operated motor 64 is mounted to a strap 66 at the back of the machine, the strap 66 being part of the frame 10. The forwardly projecting piston rod 68 of the motor 64 is secured to a bar 70 that extends between the opposite sides of the machine. The opposite ends of the bar 70 are each connected, by a pivot pin 72, to the back of a rod 74. The rods 74 are each slidably mounted to the frame 10 for forward-rearward movement. A head 76 is mounted to the front of each rod 74. Inner and outer rollers 78 are rotatably mounted to the top and bottom of each head 76. The outer rollers 78 on each head 76 are in engagement with a forward-rearwardly extending surface 80 on the frame 10 and the inner rollers 78 on each head 76 are located outwardly of their associated plates 54 and 56.

Figure 10:
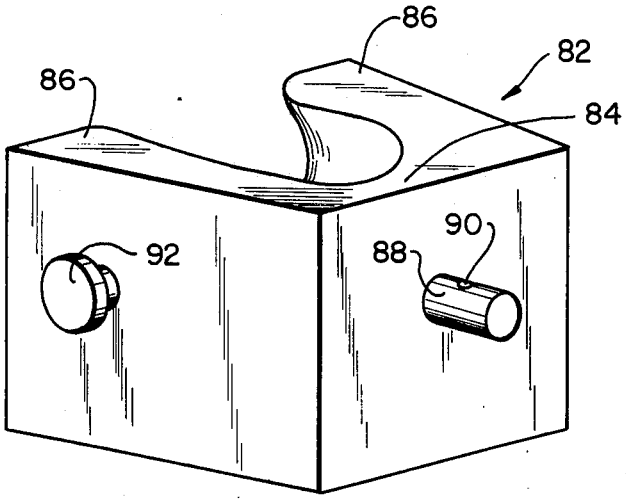
FIG. 10 is an isometric view of the clamp pad.

FIG. 10 shows a heel clamp pad 82 having a bight 84 and legs 86 extending forwardly and divergently of the bight. The pad 82 is formed of a flexible and deformable material such as polyurethane. A prong 88 extends rearwardly of the bight 84 and a hole 90 extends transversely through the prong 88. A headed stud 92 projects outwardly of each pad leg 86.

Figure 2:
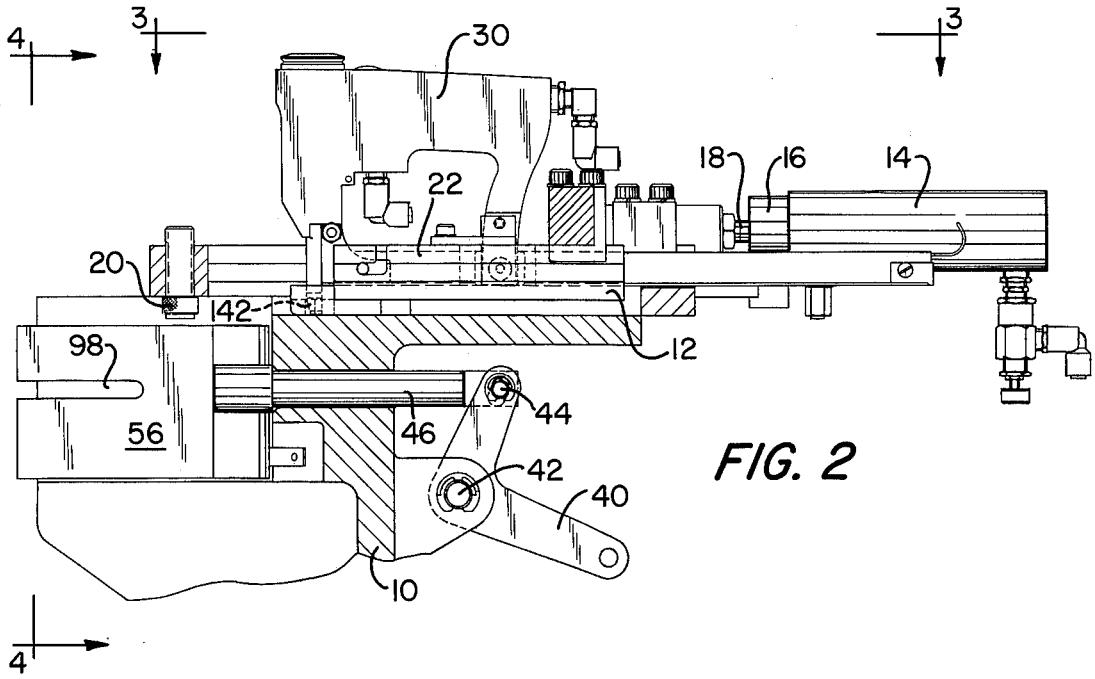
FIG. 2 is a sectional view showing one of the plates to which the clamp pad legs are connected.
Figure 4:
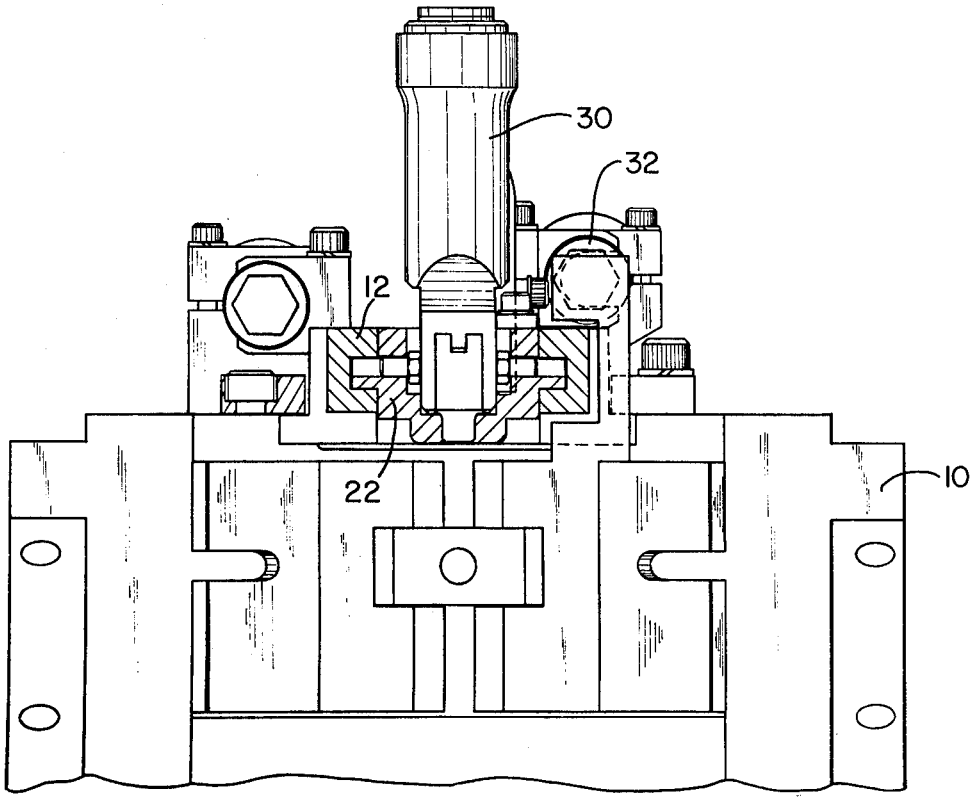
FIG. 4 is a front view taken on line 4—4 of FIG. 2.

As shown in FIG. 6, a forwardly facing recess 94 is provided in the front of the rod 46 and a heightwise extending hole 96 extends through the front of the rod and intersects the recess 94. As shown in FIGS. 2, 5 and 9, slots 98 are formed in the plates 54 and 56. The heel clamp pad 82 is mounted in the machine by seating the prong 88 in the recess 94 with a retaining pin 99 extending through the holes 90 and 96 and by fitting the studs 92 in the slots 98 with the heads of the studs 92 located outwardly of the slots and bearing against the outer surfaces of the plates 54 and 56.

Figure 7:
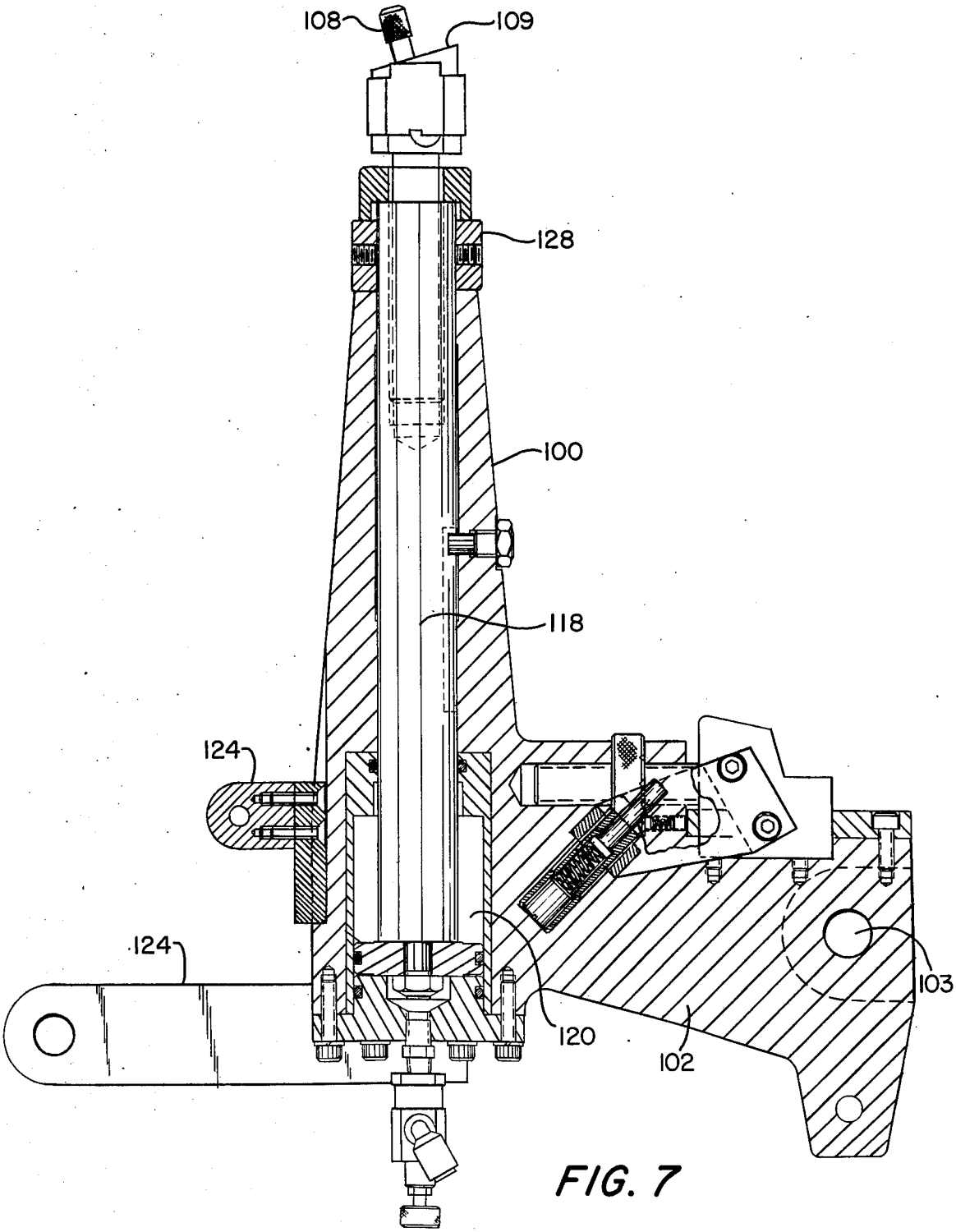
FIG. 7 is a section of a shoe assembly support arrangement in the machine.

A shoe assembly support arrangement is shown in FIG. 5. In this arrangement, a post 100 is secured to a lever 102 that is pivotally mounted to the frame 10 for swinging movement about the axis of a pin 103. An air operated motor 104, that is mounted to the frame 10, has a forwardly directed piston rod 106 that is pivotally connected to the lever 102 whereby the motor 104 may effect forward-rearward swinging movement of the post 100 about the axis of the pin 103. A last pin 108 and a support plate 109 are mounted for heightwise movement in and extend upwardly of the post 100. A latch 110 is pivoted to the frame 10 for swinging movement towards and away from a detent 112 on the lever 102. An air actuated motor 114, pivotally mounted to the frame 10, has a piston rod 116 that is pivoted to the latch 110 whereby the motor 114 may affect movement of the latch 110 towards and away from the lever 102. The piston rod 118 (see FIG. 7) of an air operated motor 120 located within the post 100 is connected to the last pin 108 and the support plate 109 whereby the motor 120 may effect heightwise movement of the last pin 108 and the support plate 109.

If desired, the shoe assembly support arrangement may incorporate, as shown in FIG. 1, a toe rest 122 located forwardly of the post 100. The toe rest 122 is connected by connection members 124 to a sleeve 126 that extends about the post 100. The sleeve 126 is secured to a collar 128 (FIG. 7) that is in turn secured to the piston rod 118 whereby the motor 120 affects heightwise movement of the toe rest 122 as well as the last pin 108 and the support plate 109.

As shown in FIG. 1, the motor 104 may be so mounted to the frame 10 as to have its piston rod 106 extend upwardly towards its pivotal connection with the lever 102.

In the idle condition of the machine: the piston rod 18 is retracted into the motor 14 so that the hold-down slide 12, together with the hold-down 20, is in a rearward position on the slide 12; the piston rod 28 is retracted into the motor 24 so that the staple gun 30 is in a rearward position on the slide 22; the piston rod 38 is retracted into the motor 34 so that the heel clamp pad 82 is in a rearward position in the machine with the spring 62 yieldably urging the plates 54 and 56 outwardly to thereby yieldably urge the pad legs 86 outwardly, the plates 54 and 56 being inclined forwardly and outwardly with respect to the longitudinal center line of the machine to form acute angles with their associated surfaces 80; the piston rod 68 is retracted into the motor 64 so that the rollers 78 are in rearward positions in the machine spaced from the plates 54 and 56 as indicated in FIG. 6; the piston rod 106 is retracted into the motor 104 so that the shoe assembly support members 108, 109 and 122 are in forward positions; the piston rod 116 is retracted into the motor 114 so that the latch 110 is raised; and the piston rod 118 is retracted into the motor 120 so that the shoe assembly support members 108, 109 and 122 are in lowered positions.

Figure 11:
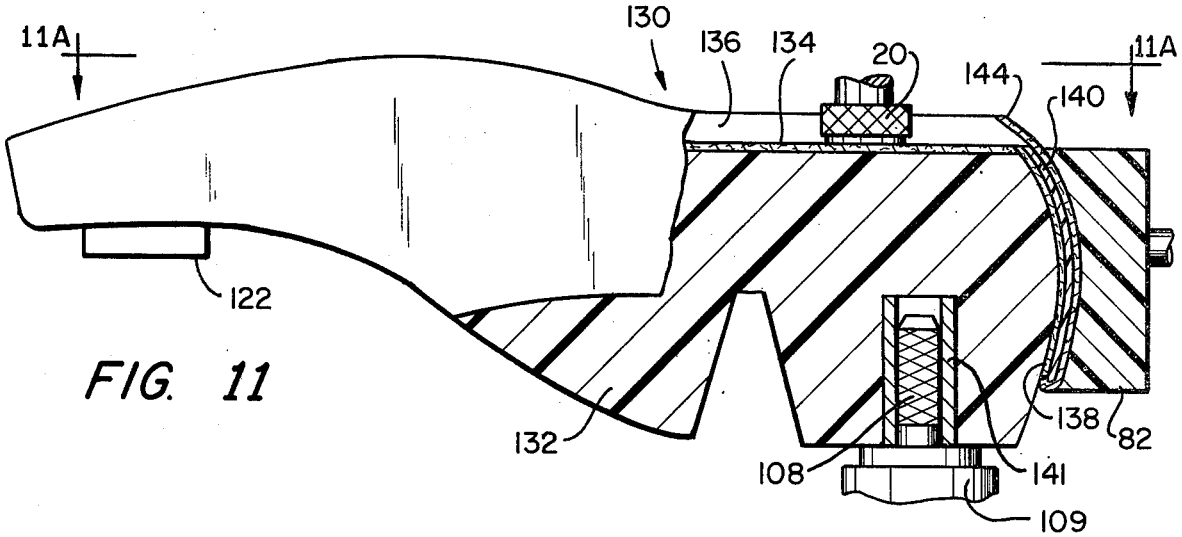
FIG. 11 is a representation in partially sectional elevation of a shoe assembly as it appears in the machine while being clamped by the clamp pad.
Figure 11A:
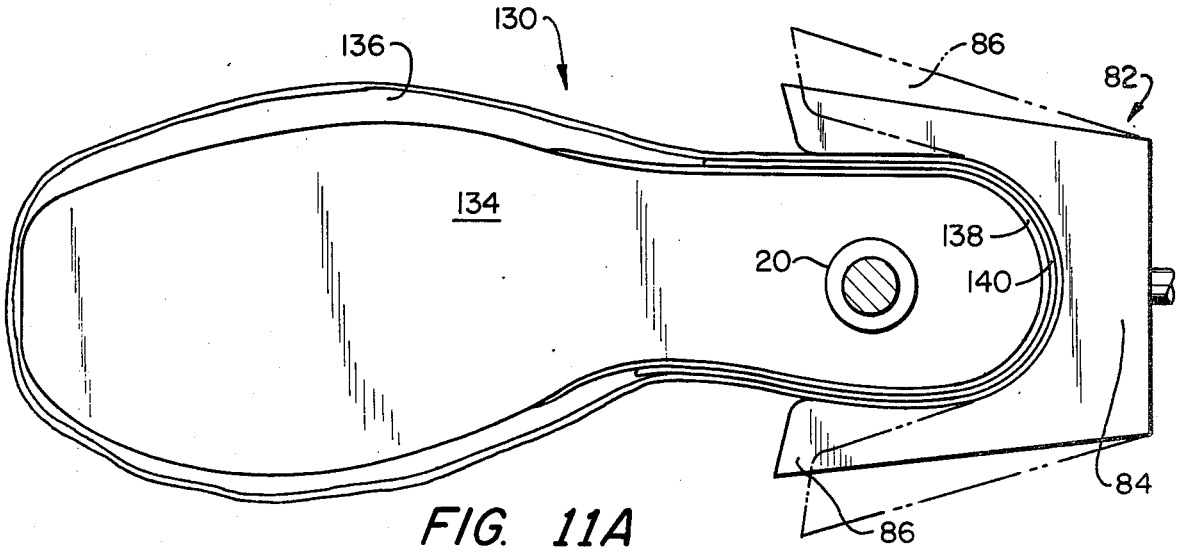
FIG. 11A is a plan view taken on the line 11A—11A of FIG. 11.

FIGS. 11 and 11A show a shoe assembly 130 comprising a last 132 having an insole 134 secured to its bottom and an upper 136 mounted thereon. A liner 138 is so stitched to the heel portion of the upper 136 as to form a counter pocket between the liner and the heel portion of the upper. A thermoplastic counter 140 is disposed within the counter pocket. The counter is so constituted as to be relatively rigid and shape sustaining at ambient temperatures and to become relatively soft and moldable when heated a certain amount above ambient temperatures.

The shoe assembly 130 is mounted bottom-up on the shoe assembly support members 108, 109 and 122 with the last pin 108 entering the conventional thimble 141 at the top of the heel end of the last 132, with the support plate 109 supporting the top of the heel end of the last 132, and with the toe rest 122 supporting the top of the forepart of the shoe assembly 130. At this time, the upwardly facing bottom of the counter 140 is substantially level with the bottom of the insole 134, the heel portion of the upwardly facing bottom margin of the upper 136 extends above the insole, and the counter is in its soft and moldable condition due to the heel portion of the upper-counter assembly having been heated prior to the mounting of the upper-counter assembly on the last.

At the commencement of a machine cycle, the motor 114 is actuated to project its piston rod 116 downwardly to thereby lower the latch 110 under the yieldable force of pressurized air and the motor 14 is actuated to project its piston rod 18 forwardly to thus move the hold-down 20 forwardly. This is followed by an actuation of the motor 104 to project its piston rod 106 and thereby swing the post 100, together with the shoe assembly 130, rearwardly about the axis of the pin 103. In response to this rearward movement of the post 100, the latch 110 engages the detent 112 to thereby lock the post 100 and the shoe assembly 130 in their rearward positions. After this, the motor 120 is actuated to raise its piston rod 118, together with the shoe assembly 130, under the yieldable force of pressurized air, to a position wherein the heel seat portion of the insole 134 bears against the hold-down 20, to thus place the heel seat portion of the insole at a level that is lower than the level of the bottom of the staple guide body 142 (FIG. 2) of the staple gun 30 by an amount that is substantially equal to the thickness of the margin of the upper 136. The shoe assembly 130 is thus clamped between the shoe assembly support members 109, 122 and the hold-down 20.

Now the motor 34 is actuated to project its piston rod 38 and thus move the rod 46, together with the heel clamp pad 82, forwardly under the force of pressurized air until the pad bight 84 engages the heel end of the shoe assembly 130 with the pad legs 86 extending away from the sides of the heel portion of the shoe assembly 130, as indicated in phantom in FIG. 11A. During this forward movement of the heel clamp pad the plates 54 and 56 move forwardly along the surfaces 80 while retaining the same angular orientation with respect to the surfaces 80.

After the pad bight 84 has engaged the heel end of the shoe assembly 130, the motor 64 is actuated to project its piston rod 68 forwardly under the yieldable force of pressurized air to thereby move the heads 76 between the plates 54, 56 and the surfaces 80 with the outer rollers 78 rolling along the stationary surfaces 80 and the inner rollers 78 rolling along the swingably mounted plates 54, 56. The plates 54, 56 are thus caused to swing inwardly about the axes of the pins 52 to thereby move the pad legs 86 inwardly until the flexible and deformable pad legs fully engage the sides of the heel portion of the shoe assembly 130, as indicated in solid lines in FIG. 11A. The full engagement of the pad legs 86 with the sides of the heel portion of the shoe assembly creates a resistance to further forward movement of the piston rod 68 by the pressurized air in the motor 64.

The location of the plates 54, 56 at the end of the forward movement of rod 46 caused by the engagement of the pad bight 84 with the heel end of the shoe assembly 130 depends on the spacing between the thimble 141 and the heel end of the assembly and this spacing depends, among other things, on the size and style of the shoe assembly. Since the plates 54, 56 retain their angular relationship with the surfaces 80 during the forward movement of the rod 46, the forces applied by the inner rollers 78 to the plates 54, 56 to effect inward movement of the pad legs 86 will be substantially the same regardless of how far the rod 46 has moved the plates 54, 56 forwardly.

The pressing of the pad 82 against the heel portion of the shoe assembly 130 by the operation of the motors 34 and 64 causes the pad to mold or shape the upper to the shape of the heel portion of the last 132, this being facilitated by the soft and moldable condition of the counter 140. Since the plates 54, 56 are located outwardly of the axes of the pins 52, the plates 54, 56, as well as the pad legs 86, have a forward or toeward component of movement during the inward swinging movement of the plates 54, 56 about the axes of the pins 52. This toeward component of movement of the pad legs 86 enables the pad legs to stretch the upper 136 toewardly of the last 132 before the pad legs press the upper rigidly against the last.

The pins 52 are located close to and on opposite sides of the longitudinal center line of the pad 82. Therefore, when the plates 54, 56 are swung inwardly about the axis of the pins 52 they cause the pad legs 86 to apply forces to the sides of the heel portion of the upper 136 that are substantially radial to the curvatures of the corresponding side portion of the last 132.

Figure 12:
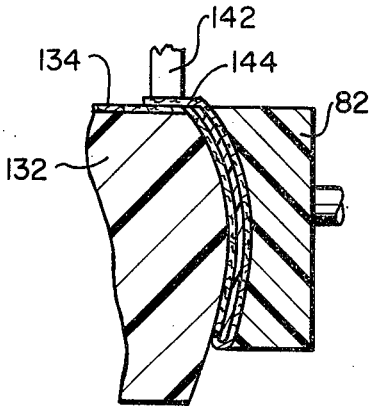
FIG. 12 is a sectional representation of the shoe assembly as it appears in the machine while a staple is attaching the heel of an upper mounted on a last to an insole mounted on the bottom of the last.

After the pad 82 has been caused to press the upper 136 against the heel portion of the last 132, the motor 24 is actuated to project its piston rod 28 forwardly to thereby move the staple gun 30 forwardly under the force of pressurized air in the motor 24 until the prong 32 on the staple gun slide 22 engages the lug 58. During this forward movement of the staple gun 30, the staple guide body 142 intersects the heel end extremity 144 (FIG. 11) of the upper margin and folds it down against the insole, as indicated in FIG. 12. After the staple gun 30 has completed its forward movement, the staple gun 30 is actuated to project a staple through the guide body 142 to thereby cause the staple to attach the folded heel end extremity 144 of the upper margin to the insole 134.

Since the lug 58 is formed on the finger 50 and since the forward-rearward position of the finger 50, when the staple gun 30 is moved forwardly by the motor 24, is determined by the location of the heel end extremity of the shoe assembly 130, the position of engagement of the prong 32 with the lug 58 bears a prescribed relationship to the position of the heel end of the shoe assembly. This relationship is such that the staple gun 30 completes its forward movement when the staple guide body has moved a prescribed distance forwardly of the heel end extremity of the shoe assembly regardless of the location of the heel end extremity of the shoe assembly thereby ensuring that the staple projected into the upper margin is located a desired distance inwardly of the heel end extremity of the shoe assembly and also ensuring that the staple guide body is located above the heel end extremity 144 of the upper margin when the staple is fired and is not located forwardly of the upper margin heel end extremity.

After the staple has been fired to attach the upper margin heel end extremity 144 to the insole 134 and after enough time has passed so that the counter 140 has cooled sufficiently to revert to its rigid, shape-sustaining condition, the machine parts are returned to their idle conditions and the shoe assembly is removed from the machine.

There follows a recapitulation of the machine parts and the mode of operation of the machine that are pertinent to this invention.

The machine includes support means formed of the members 108, 109, 122 that so support the shoe assembly 130 that the heel of the shoe assembly faces rearwardly. The shoe assembly includes the form 132 having the upper 136 mounted thereon. The clamp pad 82, having the pair of legs 86 extending forwardly and divergently from the bight 84, is so located that the bight is rearward of the heel and extremity of the shoe assembly and the legs are located outwardly of the sides of the heel portion of the shoe assembly. Pad bight mounting and operating means are operable to cause the pad bight to bear against the heel end extremity of the shoe assembly 130. The machine has pad leg mounting and operating means operable to cause the pad legs 86 to bear against the sides of the heel portion of the shoe assembly.

The pad leg mounting and operating means comprise the plates 54, 56 located outwardly of each pad leg 86. The plates 54, 56 are mounted for inward-outward pivotal movement on the pins 52 that pivotally mount the plates to the rod 46, the pivot pins 52 being located inwardly of the backs of the plates 54, 56. The plates 54, 56 are connected to their associated pad legs by the studs 92. The spring 62 constitutes resilient means urging the plates 54, 56, together with the pad legs 86, outwardly into the initial plate positions shown in FIGS. 3 and 6 wherein the plates are inclined forwardly and outwardly, the spring 62 extending between the backs of the plates 54, 56 and being so connected to the plates as to yieldably urge the backs of the plates toward each other. The heads 76 are mounted for forward-rearward movement in intersecting relationship with their associated plates 54, 56. The motor 64 acts as means for initially retaining the heads 76 in initial head positions that are rearward of their associated plates 54, 56 and also acts as means for yieldably urging the heads forwardly of their initial head positions to thereby cause the heads to engage the plates 54, 56 and yieldably force the plates, together with the pad legs 86, inwardly of the initial plate positions. Each head 76 is interposed between its associated plate 54, 56 and its associated fixed forward-rearwardly extending surface 80, each surface 80 being located outwardly of its associated pad leg 86. The plates 54, 56 in their initial plate positions form acute angles with their associated surfaces 80, and the outer peripheries of the heads 76, constituted by the peripheries of the outer rollers 78, are movable along their associated surfaces 80. The widths of the heads 76 are such that, when the plates 54, 56 are in their initial plate positions, the widths of the heads are more than the spaces between the backs of their associated plates 54, 56 and their associated surfaces 80 and the widths of the heads are less than the spaces between the fronts of their associated plates 54, 56 and their associated surfaces 80.

The pad bight mounting and operating means comprises the rod 46 that is located rearwardly of the pad bight 84 and is mounted for forward-rearward movement. The retaining pin 99 forms means mounting the pad bight 84 to the front of the rod 46. The motor 34 acts as means for initially retaining the rod 46 in an initial rearward rod position and for yieldably urging the rod forwardly of the initial rod position prior to the yieldable urging of the heads 76 forwardly of their initial head positions by the motor 64.

The pivotal connections between the plates 54, 56 and the rod 46 comprises fingers 48, 50 extending inwardly of the backs of the plates 54, 56, the fingers 48, 50 being pivoted to the rod 46 by the pins 52 and the lug 58 being formed on the finger 50. The staple gun 30 constitutes an attaching mechanism that is mounted for forward movement from an initial attaching mechanism position that is rearward of the position that the pad bight 84 assumes when the rod 46 is in its initial rod position. The prong 32, which is mounted to the attaching mechanism 30 for movement therewith, is located rearwardly of and in registry with the lug 58. The motor 24 acts as means for yieldably urging the attaching mechanism 30 forwardly of its initial attaching mechanism position subsequent to the yieldable urging of the heads forwardly of their initial head positions by the motor 64, the intersection of the prong 32 with the lug 58 arresting the forward movement of the attaching mechanism. The actuation of the staple gun 30 to project a staple through the guide body 142 constitutes means for causing the attaching mechanism to cause attachment of the heel end portion 144 of the upper margin to the insole 134 after the attaching mechanism has completed its forward movement.

I claim:

1. A machine for clamping the heel portion of an upper to the corresponding portion of a form that comprises: support means for so supporting a shoe assembly formed of a form having an upper mounted thereon that the heel of the shoe assembly faces rearwardly; a clamp pad, having a pair of legs extending forwardly and divergently from a bight, so located that the bight is rearward of the heel end extremity of the shoe assembly and the legs are located outwardly of the sides of the heel portion of the shoe assembly; pad bight mounting and operating means operable to cause the pad bight to bear against the heel end extremity of the shoe assembly; and pad leg mounting and operating means operable to cause the pad legs to bear against the sides of the heel portion of the shoe assembly; wherein the pad leg mounting and operating means comprises: a plate located outwardly of each pad leg; means mounting each plate for inward-outward movement; connecting means connecting each plate to its associated pad leg; resilient means yieldable urging the plates, together with the pad legs, outwardly into initial plate positions such that the plates are inclined forwardly and outwardly; a head associated with each pad leg mounted for forward-rearward movement in intersecting relationship with its associated plate; means for initially retaining each head in an initial head position that is rearward of its associated plate; and means for yieldably urging each head forwardly of its initial head position to thereby cause the heads to engage the plates and yieldably force the plates, together with the pad legs, inwardly of said initial plate positions.

2. The machine of claim 1 further comprising: a fixed forwardly-rearwardly extending surface located outwardly of each pad leg, the outer periphery of each head being movable along its associated surface; wherein the plates in the initial plate positions form acute angles with their associated surfaces; wherein each head is interposed between its associated plate and its associated surface; and wherein each head has a width that is more than the space between the back of its associated plate and its associated surface and that is less than the space between the front of its associated plate and its associated surface when the plate is in said initial plate position.

3. The machine of claim 1 wherein the means mounting each plate for inward-outward movement comprises: a rod located rearwardly of the pad bight; and pivot means mounting the plates to the rod for pivotal movement.

4. The machine of claim 3 wherein said pivot means are located inwardly of the backs of said plates.

5. The machine of claim 3 wherein said resilient means comprises: spring means, connected to and extending between the backs of the plates, yieldably urging the backs of the plates toward each other.

6. The machine of claim 4 wherein said resilient means comprises: spring means, connected to and extending between the backs of the plates, yieldably urging the backs of the plates toward each other.

7. The machine of claim 1 wherein said pad bight mounting and operating means comprises: a rod, located rearwardly of the pad bight, mounted for forward-rearward movement; means mounting the pad bight to the front of the rod; means for initially retaining the rod in an initial rearward rod position; and means for yieldably urging the rod forwardly of said initial rod position prior to the yieldable urging of the heads forwardly of their initial head positions; and wherein the means mounting each plate for inward-outward movement comprises: pivot means mounting the plates to the rod for pivotal movement.

8. The machine of claim 7 wherein said pivot means are located inwardly of the backs of the plates.

9. The machine of claim 7 wherein said resilient means comprises: spring means, connected to and extending between the backs of the plates, yieldably urging the backs of the plates toward each other.

10. The machine of claim 8 wherein said resilient means comprises: spring means, connected to and extending between the backs of the plates, yieldably urging the backs of the plates toward each other.

11. The machine of claim 2 wherein the means mounting each plate for inward-outward movement comprises: a rod located rearwardly of the pad bight; and pivot means mounting the plates to the rod for pivotal movement.

12. The machine of claim 11 wherein said pivot means are located inwardly of the backs of said plates.

13. The machine of claim 11 wherein said resilient means comprises: spring means, connected to and extending between the backs of the plates, yieldably urging the backs of the plates toward each other.

14. The machine of claim 12 wherein said resilient means comprises: spring means, connected to and extending between the backs of the plates, yieldably urging the backs of the plates toward each other.

15. The machine of claim 2 wherein said pad bight mounting and operating means comprises: a rod, located rearwardly of the pad bight, mounted for forward-rearward movement; means mounting the pad bight to the front of the rod; means for initially retaining the rod in an initial rearward rod position; and means for yieldably urging the rod forwardly of said initial rod position prior to the yieldable urging of the heads forwardly of their initial head positions; and wherein the means mounting each plate for inward-outward movement comprises: pivot means mounting the plates to the rod for pivotal movement.

16. The machine of claim 15 wherein said pivot means are located inwardly of the backs of the plates.

17. The machine of claim 15 wherein said resilient means comprises: spring means, connected to and extending between the backs of the plates, yieldably urging the backs of the plates toward each other.

18. The machine of claim 16 wherein said resilient means comprises: spring means, connected to and extending between the backs of the plates, yieldably urging the backs of the plates toward each other.

19. The machine of claim 8 wherein said pivot means comprises: a finger extending inwardly of the back of each plate that is pivoted to the rod; a lug formed on one of said fingers; an attaching mechanism mounted for forward movement from an initial attaching mechanism position that is rearward of the position the pad bight assumes when the rod is in said initial rod position; a prong, located rearwardly of and in registry with the lug, mounted to the attaching mechanism for movement therewith; means for yieldably urging the attaching mechanism forwardly of said initial attaching mechanism position subsequent to the yieldable urging of the heads forwardly of their initial head positions, the intersection of the prong with the lug arresting the forward movement of the attaching mechanism; and means for causing the attaching mechanism to cause attachment of the heel end portion of the margin of the upper to an insole located on the form bottom after the attaching mechanism has completed its forward movement.

20. The machine of claim 19 wherein said resilient means comprises: spring means, connected to and extending between the backs of the plates, yieldably urging the backs of the plates toward each other.

21. The machine of claim 16 wherein said pivot means comprises: a finger extending inwardly of the back of each plate that is pivoted to the rod; a lug formed on one of said fingers; an attaching mechanism mounted for forward movement from an initial attaching mechanism position that is rearward of the position the pad bight assumes when the rod is in said initial rod position; a prong, located rearwardly of and in registry with the lug, mounted to the attaching mechanism for movement therewith; means for yieldably urging the attaching mechanism forwardly of said initial attaching mechanism position subsequent to the yieldable urging of the heads forwardly of their initial head positions, the intersection of the prong with the lug arresting the forward movement of the attaching mechanism; and means for causing the attaching mechanism to cause attachment of the heel end portion of the margin of the upper to an insole located on the form bottom after the attaching mechanism has completed its forward movement.

22. The machine of claim 20 wherein said resilient means comprises: spring means, connected to and extending between the backs of the plates, yieldably urging the backs of the plates toward each other.

* * * * *

UNITED STATES PATENT AND TRADEMARK OFFICE

CERTIFICATE OF CORRECTION

PATENT NO. : 4068336

DATED : January 17, 1978

INVENTOR(S) : Michael M. Becka

It is certified that error appears in the above-identified patent and that said Letters Patent are hereby corrected as shown below:

Column 5: line 16, change "2" to --12--.

Column 7: line 38, change "more" to --less--; line 41, change "less" to --more--.

Column 8: line 30, change "yieldable" to --yieldably--; line 50, change "more" to --less--; line 52, change "less" to --more--.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*

Disclaimer 4,068,336.—*Michael M. Becka*, Nashua, N.H. MACHINE FOR CLAMPING THE HEEL PORTION OF AN UPPER TO THE CORRESPONDING PORTION OF A FORM. Patent dated Jan. 17, 1978. Disclaimer filed Aug. 23, 1978, by the assignee, *International Shoe Machine Corporation.*

Hereby enters this disclaimer to claims 1 through 18 of said patent.

[*Official Gazette October 17, 1978.*]

UNITED STATES PATENT AND TRADEMARK OFFICE

CERTIFICATE OF CORRECTION

PATENT NO. : 4068336

DATED : January 17, 1978

INVENTOR(S) : Michael M. Becka

It is certified that error appears in the above–identified patent and that said Letters Patent are hereby corrected as shown below:

Column 10: line 51, change "20" to --21--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*